US007137484B2

(12) United States Patent
Martin

(10) Patent No.: US 7,137,484 B2
(45) Date of Patent: Nov. 21, 2006

(54) SAFETY SYSTEM FOR RESTRAINING MOVEMENT OF ELEVATOR CAR WHEN CAR DOORS ARE OPEN

(75) Inventor: Matthew Martin, Randolph, NJ (US)

(73) Assignee: Inventio AG, Hergiswil (CH)

( * ) Notice: Subject to any disclaimer, the term of this patent is extended or adjusted under 35 U.S.C. 154(b) by 449 days.

(21) Appl. No.: 10/445,431

(22) Filed: May 27, 2003

(65) Prior Publication Data

US 2004/0238288 A1 Dec. 2, 2004

(51) Int. Cl.
*B66B 5/16* (2006.01)

(52) U.S. Cl. ..... 187/354; 187/373

(58) Field of Classification Search ..... 187/280, 187/286, 287, 288, 299, 301, 305, 316, 350, 187/351, 373, 394, 399, 354, 355, 359; 188/180, 188/187–189

See application file for complete search history.

(56) References Cited

U.S. PATENT DOCUMENTS 1,635,265 A * 7/1927 Darby ..... 187/324
1,997,260 A * 4/1935 Lindquist et al. ..... 187/398
2,032,475 A * 3/1936 Dunn ..... 187/382
2,093,074 A * 9/1937 Dickinson ..... 187/389
4,556,155 A 12/1985 Koppensteiner
4,923,055 A * 5/1990 Holland ..... 187/288
5,183,979 A * 2/1993 Sheridan et al. ..... 187/280
5,228,540 A * 7/1993 Glaser ..... 187/355
5,321,216 A 6/1994 Jamieson et al.
5,368,131 A * 11/1994 Yoshihiro ..... 187/301
6,003,636 A * 12/1999 Yumura ..... 187/376
6,340,073 B1 * 1/2002 Lee et al. ..... 187/309

* cited by examiner

*Primary Examiner*—Dean J. Kramer
(74) *Attorney, Agent, or Firm*—Butzel Long

(57) ABSTRACT

A safety system for restraining movement of an elevator car employing a bi-directional safety and an associated car mounted governor with a linkage, between the governor and the elevator car door, including a brake cable and clutch, wherein the governor would operate normally when the elevator car door is closed to set the safety in the event overspeed in either direction. When the door is open more than two (2) inches, for example, the governor would set the safety in the event the car moved more than a predetermined distance.

11 Claims, 1 Drawing Sheet

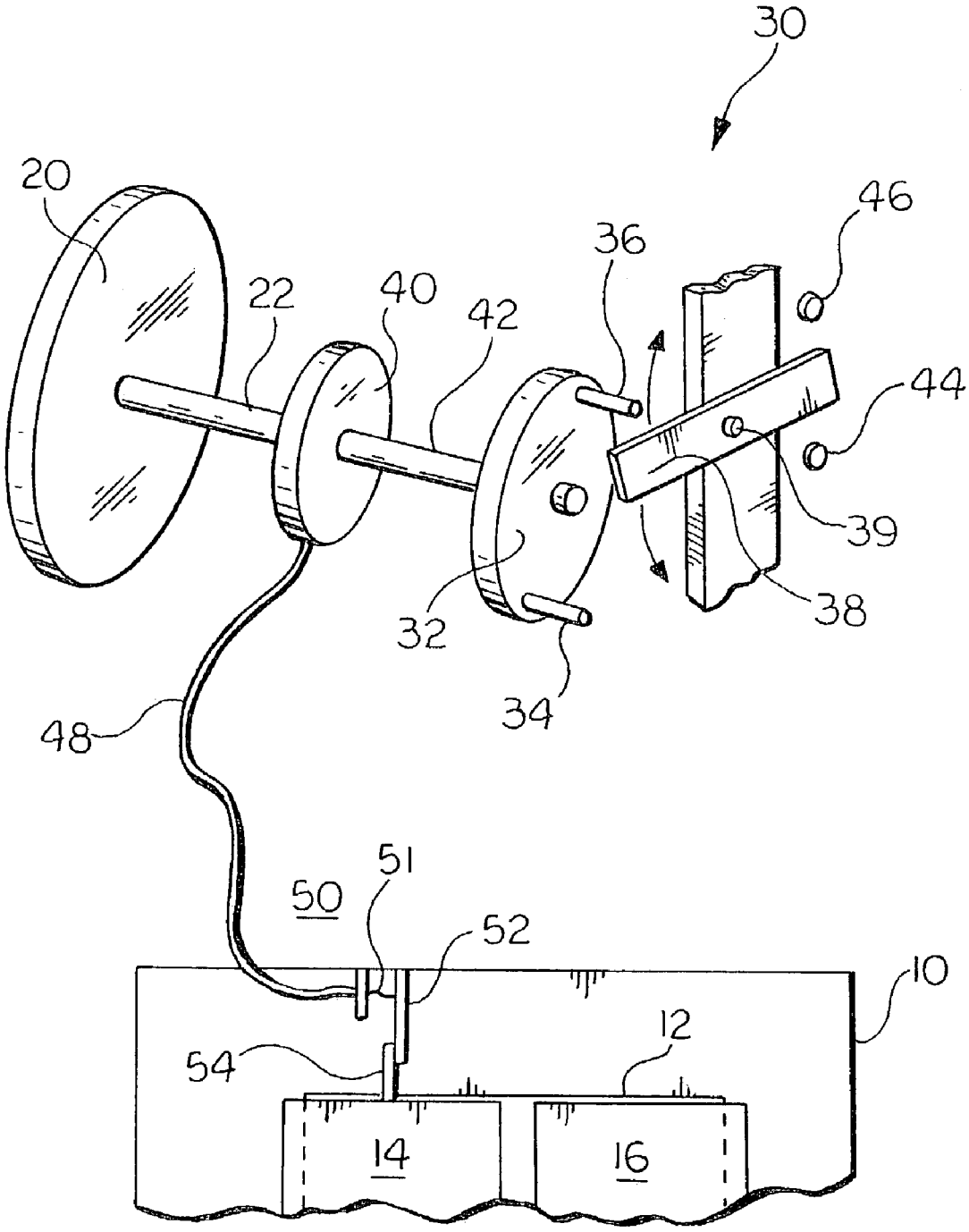
30
20
46
36
22
40
42
44
39
38
32
34
48
51
50
52
10
12
54
14
16

SAFETY SYSTEM FOR RESTRAINING MOVEMENT OF ELEVATOR CAR WHEN CAR DOORS ARE OPEN

BACKGROUND OF THE INVENTION

1. Field of the Invention

The present invention relates to an elevator car safety device. More particularly, the invention relates to an elevator car safety system which is operative to restrain movement of the car when the car doors are open.

2. Description of the Prior Art

Elevator systems of the prior art typically include an elevator car connected to a counterweight by means of a steel cable which is adapted to extend over a sheave located in the machine room located at the top of an associated elevator shaft. The sheave is connected to a hoist motor provided to effect vertical movement of the elevator car in the elevator shaft.

The hoist motor, provided with a brake, is connected to the sheave to control the rotation of the sheave and thus the vertical motion imparted to the elevator car. The brake is directly connected to the sheave and is employed to hold the elevator car in a stationary position.

The system further includes a safety governor which includes a governor rope which passes over a safety governor pulley located in the machine room and then extends downwardly to a tensioning pulley located at the bottom of the elevator shaft and then extends back to the governor pulley. The governor rope is typically connected to a progressive safety mounted in the elevator car. The safety governor is adapted to detect an overspeed condition of the elevator car based upon a ratio of the rotational velocity of the governor pulley proportional to the speed of the elevator car.

Safety governors are known in the prior art such as the governor illustrated and described in U.S. Pat. No. 4,556,155. The governor is provided with two diametrically opposed flyweights disposed on the governor pulley. In operation, as the elevator car travels up and down the elevator shaft, the flyweights move outwardly due to the centrifugal force imparted thereon by the rotating governor pulley.

When the speed of the elevator car exceeds a rated speed by a predetermined value, the flyweights are driven outwardly and are caused to trip an overspeed switch which cuts off power to the drive motor and simultaneously sets the brake.

In the event the elevator car speed continues to increase, the further outward motion of the flyweights causes the flyweights to contact and trip a mechanical latching device, releasing a swinging jaw which is normally held away from the governor rope. When the swinging jaw is released, it clamps the governor rope against a fixed jaw, thereby retarding governor rope motion. The retarding action exerted on the governor rope causes safeties located on the elevator car to engage, thereby progressively decelerating and ultimately arresting the motion of the elevator car.

There are a number of safeties known in the prior art, such as, for example, a safety having a roller located between the elevator car guide rail and a leaf spring. The leaf spring and the guide rail form a triangular section with the roller located at the base of the triangular section during normal operation.

The force exerted on the governor rope causes a safety gear linkage to lift the roller into the tapered portion of the triangular section. The leaf spring exerts pressure on the guide rail by way of the roller, and the pressure is progressively increased as the roller moves into the tapered portion of the triangular section. The executed pressure gradually decelerates and ultimately arrests the motion of the elevator car.

In operation, an elevator car is dispatched to a floor in response to a hall call and/or a car call. For the sake of efficiency, it is desirable to have the elevator car door begin to open prior to the car coming to a complete stop at the floor landing. Safety codes permit the elevator car door to commence opening prior to the elevator car coming to a complete stop. The codes permit such operation if the elevator car is within a predetermined zone, commonly referred to as an outer door zone, and a further proviso that the elevator car is travelling below a predetermined speed. The outer door zone is typically defined as a zone twenty-four (24) inches centered about the floor landing.

The arriving elevator car decelerates and, upon reaching the outer door zone, commences opening the car door. The elevator car will hover at the landing until it is level with the landing. When the elevator car is properly positioned at the landing, the brake is set and the drive motor is de-energized. In the event the elevator car should drift from the landing, the drive motor is caused to be re-energized to cause the car to be moved to the proper landing level.

Normally, an engaged drive and a set brake are each capable of holding the elevator car at the landing and/or stationary. However, in the event the drive or the brake should malfunction, the elevator car can drift away from the landing.

Other approaches to solve the problem include the use of electronic circuitry to monitor the speed of the elevator car, the position of the elevator car, and the state of the elevator car door. Once these parameters are within a certain predetermined range, a rope or cable brake is activated or an independent machine brake is activated.

Safety codes are being promulgated to require that a drifting elevator car should be stopped should the elevator car drift more than twenty (20) inches from a landing with the door in an open position. More specifically, the codes provide that if an elevator car drifts more than twenty (20) inches from a landing with the door open, the elevator car must be brought to a complete stop within another thirty (30) inches.

It is an object of the present invention to produce a safety system which will prevent further movement of the elevator car should the car drift beyond a predetermined distance with the door in an open position.

SUMMARY OF THE INVENTION

The above object of the invention may be typically achieved by a safety system to restrain movement of an elevator car when the doors of the elevator are open causing an associated governor to rotate upon movement of the car and thereby set a safety brake.

BRIEF DESCRIPTION OF THE DRAWING

The above object and advantages of the invention will become readily apparent to those skilled in the art from reading the following detailed description of a preferred embodiment of the invention when considered in the light of the accompanying drawings, in which:

There is a schematic illustration of a safety system for an elevator embodying the features of the invention.

DETAILED DESCRIPTION OF THE PREFERRED EMBODIMENT

Referring to the drawing, there is illustrated a safety system for an elevator including an elevator car 10 having an entryway 12 which is closed by doors 14 and 16 at least one of which is slidably movable between open and closed positions. The elevator car 10 is mounted for vertical movement in an associated elevator shaft of a building between the landings of the various floors of the building. Vertical travel of the elevator car 10 is guided by guide rails attached to the elevator shaft. A drive motor is typically mounted in a machine room located at the top of the elevator shaft and is employed to selectively hoist or lower the elevator car in response to car calls or hall calls in accordance with well known control circuitry.

The system includes a governor 20 which senses the speed and the direction of travel of the car 10. The governor 20 is typically mounted on the car 10 and includes a flywheel affixed to a driving shaft 22. The driving shaft 22 rotates about its longitudinal axis and in a direction in accordance with the vertical movement of the elevator car 10. When the elevator car 10 is caused to move upwardly, the flywheel of the governor 20 drives the driving shaft 22 in one direction and, conversely, when the elevator car 10 is caused to move in an opposite direction, the flywheel of the governor 20 drives the driving shaft 22 in an opposite direction.

The governor 20 is coupled to a bi-directional safety 30 through a clutch 40 and a driven shaft 42. The safety 30 includes a flywheel 32 having a pair of diametrically mounted pins 34 and 36. An actuator arm 38 is pivotally mounted on a pivotal mounting pin 39. One of the ends of the arm 38 extends outwardly from the mounting pin 39 an amount to allow selective contact by the pins 34 and 36 as will be more fully described hereinafter. The opposite end of the arm 38 is disposed between and suitably spaced from contacts 44 and 46 which in turn are suitably coupled to an appropriate safety.

The clutch 40, normally disengaged, is employed to provide a mechanical means for engaging or disengaging the driving shaft 22 to the driven shaft 42. A clutch disengaging mechanism is comprised of a brake-type cable 48 which is comprised of an outer sheath and reciprocating inner wire 51. The cable 48 couples the clutch 40 to the movable door 14 of the elevator car 10. More specifically, the other end of the cable 48 is secured to the elevator car 10 by a bracket 50. The reciprocating inner wire 51 portion of the cable 48 is connected to a downwardly depending arm 52 which may be contacted by an upwardly extending arm 54 connected to the movable door 14 of the elevator car 10.

In operation, the elevator car 10 is dispatched to a floor, in response to either a car call or a hall call, and prior to reaching the desired floor, the governor 20 operates normally setting the associated safety (not shown) if the speed of the car 10 exceeds a predetermined speed in either direction. However, as the car 10 approaches the desired floor, and the door 14 is open mare than perhaps two (2) inches, the arm 54, mounted on the door 14, moves away from the arm 52 permitting the arm 52 to move allowing the associated reciprocating inner wire 51 to refract into the sheath of the cable 48 causing the clutch 40 to return to its normal engaged condition. Should the elevator car 10 then move more than a predetermined defined distance, the governor 20 will cause rotation of the flywheel 32 causing one of the pins 34 or 36 to contact the actuator arm 38. The arm 38 will be caused to rotate about the pin 39 in a direction determined by the direction of rotation of the flywheel 32 and thence one of the pins 34, 36 will cause the arm 38 to contact one or the other of the safety actuating contacts 44 or 46. The safety actuating contacts 44 or 46 will actuate the associated safety and promptly stop any further movement of the elevator car 10.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. A safety system for restraining movement of an elevator car comprising:

an elevator car including door means for providing access to the interior of said car;

a safety for restraining the movement of said car, said safety normally permitting movement of said car;

a governor mounted on said car for determining any overspeed of said car;

a safety actuating means coupled to said governor;

a normally disengaged clutch between said governor and said safety actuating means; and means for engaging said clutch operated by the door means of said car when the door means of said car is open to thereby actuate said safety to restrain movement of said car.

2. The safety system defined in claim 1 wherein said clutch engaging means includes a reciprocating mechanical connection between said clutch and the door means of said car.

3. The safety system defined in claim 2 wherein the reciprocating mechanical connection normally maintains said clutch disengaged.

4. The safety system defined in claim 1 wherein the door means of said car include at least one door adapted to slide between a closed position and an open position.

5. The safety system defined in claim 4 wherein said means for engaging said clutch includes a contact arm mounted on the door of said car.

6. The safety system defined in claim 1 wherein said safety actuating means includes a pivotally mounted arm and a flywheel having contact means for selectively moving said arm to actuate said safety.

7. A safety system for restraining movement of an elevator car comprising:

an elevator car including door means for providing access to the interior of said car;

a safety for restraining the movement of said car, said safety normally permitting movement of said car;

a governor mounted on said car for determining any overspeed of said car;

a safety actuating means coupled to said governor by a normally disengaged clutch; and means for engaging said clutch operated by said door means when said door means is opening, whereby said governor responds to a predetermined movement of said car to cause said safety actuating means to actuate said safety to restrain further movement of said car.

8. The safety system defined in claim 7 wherein said means for engaging said clutch includes a reciprocating mechanical connection between said clutch and said door means.

9. The safety system defined in claim 8 wherein said reciprocating mechanical connection normally maintains said clutch disengaged.

10. The safety system defined in claim 7 wherein said means for engaging said clutch includes an arm mounted on said door means.

11. The safety system defined in claim 7 wherein said safety actuating means includes a pivotally mounted actuator arm and a flywheel connected to said clutch, said flywheel having means for selectively moving said actuator arm to actuate said safety.

* * * * *